US005364552A

United States Patent [19]

Merz et al.

[11] Patent Number: 5,364,552

[45] Date of Patent: Nov. 15, 1994

[54] LIQUID NONIONIC SURFACTANT COMBINATION HAVING IMPROVED LOW-TEMPERATURESTABILITY

[75] Inventors: Thomas Merz, Hilden; Khalil Shamayeli, Duesseldorf; Werner Kuhlmann, Monheim, all of Germany

[73] Assignee: Henkel Kommanditgesellschaft auf Aktien, Duesseldorf, Germany

[21] Appl. No.: 30,011

[22] PCT Filed: Sep. 10, 1991

[86] PCT No.: PCT/EP91/01722

§ 371 Date: Mar. 22, 1993

§ 102(e) Date: Mar. 22, 1993

[87] PCT Pub. No.: WO92/05235

PCT Pub. Date: Apr. 2, 1992

[30] Foreign Application Priority Data

Sep. 20, 1990 [DE] Germany ..... 4029777

[51] Int. Cl.[5] ..... C11D 1/825; C11D 1/72; C11D 1/722; C11D 17/00

[52] U.S. Cl. ..... 252/174.22; 252/174.21; 252/DIG. 1; 252/DIG. 14

[58] Field of Search ..... 252/174.22, 174.21, 252/DIG. 1, DIG. 14

[56] References Cited

U.S. PATENT DOCUMENTS

| | | | |
|---|---|---|---|
| 4,153,570 | 5/1979 | Hennemann et al. | 252/121 |
| 4,332,692 | 6/1982 | Payne et al. | 252/135 |
| 4,348,305 | 9/1982 | Hennemann et al. | 252/542 |
| 4,743,394 | 5/1988 | Kaufmann et al. | 252/90 |
| 4,832,868 | 5/1989 | Schmid et al. | 252/356 |
| 4,889,644 | 12/1989 | Amberg et al. | 252/8.9 |
| 4,965,014 | 10/1990 | Jeschke et al. | 252/174.22 |
| 5,209,874 | 5/1993 | Kravetz et al. | 252/550 |

FOREIGN PATENT DOCUMENTS

| | | |
|---|---|---|
| 365226 | 12/1981 | Austria . |
| 0225654 | 6/1987 | European Pat. Off. . |
| 0235774 | 9/1987 | European Pat. Off. . |
| 2194955 | 3/1988 | United Kingdom . |

*Primary Examiner*—Paul Lieberman
*Assistant Examiner*—A. Hertzog
*Attorney, Agent, or Firm*—Wayne C. Jaeschke; John E. Drach; Henry E. Millson, Jr.

[57] ABSTRACT

Liquid nonionic surfactant combination having improved low temperature stability which comprises:

(a) from about 20% to about 50% by weight of an alcohol ethoxylate derived from primary linear $C_{12-15}$ alcohols having an average degree of ethoxylation equal to from about 2 to about 7;

(b) from about 20% to about 50% by weight of an alcohol alkoxylate derived from primary saturated alcohols containing 12 to 15 carbon atoms in which the alcohol radical can be linear, methyl-branched in the 2-position, or a mixture of said linear and said methyl-branched radicals, having an average degree of ethoxylation equal to from about 3 to about 7 and an average degree of propoxylation equal to from about 2 to about 8;

(c) from about 5% to about 50% by weight of an alcohol ethoxylate derived from oxoalcohol mixtures of primary, linear, and 2-methyl-branched $C_{12-15}$ alcohols having an average degree of ethoxylation equal to from about 2 to about 8.

20 Claims, No Drawings

LIQUID NONIONIC SURFACTANT COMBINATION HAVING IMPROVED LOW-TEMPERATURESTABILITY

BACKGROUND OF THE INVENTION

1. Field of the Invention

This invention relates to a liquid nonionic surfactant combination which is pourable at low temperatures and which is stable in storage over a wide temperature range from −10° to +40° C.

2. Statement of Related Art

Surfactant combinations of the type in question are used in particular as liquid concentrates together with so-called washing alkalis and are particularly suitable for the washing of oil-stained textiles and working apparel in laundries. Liquid concentrates which can be automatically metered are particularly valuable for an application such as this. In addition to the properties mentioned, liquid concentrates are virtually unaffected in their viscosity behavior by variations in temperature.

Known pourable concentrates used for purposes of the type in question typically contain solvents, more particularly low molecular weight alcohols, to guarantee the necessary low-temperature stability. In many cases, low molecular weight polyglycols or polypropylene glycol are added to them to improve not only their low-temperature stability, but also their viscosity behavior in the required manner. However, neither addition makes any contribution to the washing effect.

Accordingly, the problem addressed by the present invention was to provide a corresponding liquid concentrate which, despite no additions of solvent, would be stable over a relatively wide temperature range and which would be easy to meter at various temperatures without significant changes in viscosity. At the same time, the washing and cleaning properties, particularly with respect to oil- and grease-containing soil, would not be reduced by comparison with known leading products, but instead would be fully maintained or even increased. This problem has been solved by the invention described in detail hereinafter,

DESCRIPTION OF THE INVENTION

The present invention relates to a liquid nonionic surfactant combination having improved low-temperature stability which contains (a) 20 to 50% by weight of an alcohol ethoxylate derived from primary linear $C_{12-5}$ alcohols containing on average 2 to 7 ethylene oxide groups (EO), (b) 20 to 50% by weight of an alcohol alkoxylate derived from primary $C_{12-15}$ alcohols containing an average of 3 to 7 ethylene oxide groups (EO) and 2 to 8 propylene oxide groups (PO), (c) 5 to 50% by weight of an alcohol ethoxylate derived from mixtures of primary, linear and 2-methyl-branched $C_{12-15}$ alcohols (oxoalcohols) containing an average of 2 to 8 ethylene oxide groups.

All the degrees of alkoxylation mentioned are statistical mean values which may be a whole or broken number for a special product. Preferred alcohol alkoxylates (a) and (b) are the narrow-range ethoxylates (nre). Alcohol alkoxylates (b), in which the propylene oxide distribution also corresponds to a narrow-range homolog distribution, are particularly preferred.

The nonionic component (a) preferably consists of an alcohol ethoxylate derived from primary, saturated and linear alcohols containing 12 to 14 carbon atoms, for example of the type present in alcohol mixtures synthesized by the Ziegler method or obtained from native fatty acids by reduction. The preferred alcohol mixtures of native origin may contain small amounts of $C_{10}$ or $C_{16}$ alcohols, although the percentage content of $C_{16}$ alcohols should be less than 10% by weight and, more particularly, less than 5% by weight while the percentage content of $C_{10}$ alcohol should be less than 15% by weight and, more particularly, less than 10% by weight. The degree of ethoxylation (EO) of the nonionic component (a) is preferably 2 to 5. The surfactant combination preferably contains 20 to 45% by weight and, more preferably, 25 to 40% by weight of component (a).

The nonionic component (b) is derived from primary saturated alcohols containing 12 to 15 carbon atoms in which the alcohol radical may be linear or methyl-branched in the 2-position or may contain mixed linear and methyl-branched radicals such as are typically present in oxoalcohol radicals. However, linear radicals of $C_{12-14}$ alcohols of native origin, which may optionally contain corresponding amounts of $C_{10}$ and $C_{16}$ alcohol radicals, are preferred. Component (b) contains both ethylene oxide groups (EO) and propylene groups groups (PO). These groups may be statistically distributed, although it is preferred to use compounds in which the alcohol radical is first completely ethoxylated and then propoxylated, as reproduced by the schematic formula $R—(EO)_x—(PO)_y$. In this formula, R represents the alcohol radical, x represents the number of (EO) groups and y represents the number of (PO) groups. The number of EO groups is preferably from 4 to 6 while the number of PO groups is preferably from 2 to 5 and, more preferably, 2.5, 3 and 4. If the number of EO groups is larger than 5, a relatively large number of PO groups, for example 5 to 6, is also recommended. An alkoxylate containing (on average) 4 to 6 EO groups and 2 to 3 PO groups has proved to be particularly suitable in ecological terms. The percentage content of component (b) in the concentrate is preferably from 20 to 45% by weight and, more particularly, from 25 to 40% by weight.

Component (c) is derived from oxoalcohols which are known to be a mixture of linear and 2-methyl-branched alcohols, in which the percentage content of linear alcohols generally dominates. The alcohol radicals contain 12 to 15 and preferably 13 to 14 carbon atoms. Technical mixtures may additionally contain small components containing 11 or 15 carbon atoms, although their percentage content should preferably be less than 10% by weight, based on the technical mixture. The degree of ethoxylation of component (c) is preferably from 2 to 5 and, more preferably, from 2.5 to 4. The percentage content of component (c) in the concentrate is preferably from 10 to 45% by weight and, more preferably, from 15 to 40% by weight.

The concentrates may be anhydrous or may contain up to 20% by weight and preferably 5 to 15% by weight water. The water content is of minor importance so far as low-temperature stability and metering properties are concerned. However, since the nonionic surfactants (a), (b) and (c) are technical products which are obtained and marketed in various qualities and purities, the concentrates can cloud where certain technical product batches are used or can even form gel-like precipitates. Such clouding and precipitation is reliably avoided by addition of water, additions of 5 to 10% by weight generally being sufficient for this purpose.

The concentrates may contain other additives providing they are soluble and do not affect the favorable properties of the concentrates. The additives in question include, in particular, dyes and fragrances with which the color and odor of the mixtures is masked. Although solvents may basically be added, they are neither necessary nor appropriate for the reasons explained above.

The concentrates behave in the manner of newtonian liquids, in other words their viscosity is independent of the shear forces acting on them. Accordingly, they are easy to transport and to meter, their viscosity undergoing comparatively little change as a function of temperature. Even after storage for several months in a conditioned atmosphere with temperatures repeatedly changing between −10° C. and +40° C., they are stable in storage, i.e. have no tendency towards separation. The concentrates are liquid in consistency to at least 0° C. Between −10° C. and 0° C., they may be present in liquid or solid form. Even the concentrates present in solid form at temperatures of this order give clear and homogeneous liquids on thawing. These properties make them particularly suitable for fully automatic metering in institutional laundries.

Although the concentrates may be used for the preparation of wash liquors without any further additives, they are preferably used in combination with typical builders, so-called washing alkalis, co-builders and sequestering agents and other typical detergent additives.

Suitable builders are, for example, finely crystalline zeolites of the NaA type and phosphates, more particularly pentasodium triphosphate. Suitable washing alkalis are soda and sodium silicates, more particularly metasilicate and silicates having the composition $Na_2O$: $SiO_2$=1:1.5 to 1:3.3. Suitable co-builders are polymeric polycarboxylates, more particularly homopolymers of acrylic acid and copolymers of acrylic acid with maleic acid. Suitable complexing agents or sequestering agents are aminopolycarboxylates, such as sodium nitrilotriacetate, ethylenediamine tetraacetate and higher homologs thereof, phosphonates, such as 1-hydroxyethane-1,1-diphosphonate, aminotri(methylenephosphonate), ethylenediamine tetra-(methylenephosphonate) and higher homologs thereof, such as diethylenetriamine penta-(methylenephosphonate).

Other suitable additives are redeposition inhibitors, for example cellulose ethers, such as carboxymethyl cellulose, methyl cellulose, hydroxyalkyl celluloses containing $C_{2-4}$ hydroxyalkyl radicals and mixed ethers, such as alkyl hydroxyalkyl cellulose. Other suitable additives are optical brighteners, enzymes, bleaches from the class of per compounds, which are normally used together with activators, and active chlorine compounds, foam inhibitors and also dyes and fragrances.

In cases where the concentrates according to the invention are added as detergency boosters or to improve the oil- and grease-removing power of typical detergents, the detergents may also contain typical anionic and nonionic surfactants, including linear alkyl benzenesulfonates, such as $C_{9-13}$ alkyl benzene sulfonate, alkane sulfonates, α-sulfofatty acids and fatty alcohol sulfates. In addition, these detergents may contain typical nonionic surfactants, more particularly ethoxylates of $C_{12-16}$ fatty alcohols and $C_{12-16}$ oxoalcohols. Through the use of the surfactant combinations according to the invention, there are no limitations in regard to the choice and quantity of these and the above-mentioned ingredients because they are highly compatible with the substances in question.

The detergent ingredients and additives mentioned are normally stored separately from the surfactant combination according to the invention and are added to the wash liquor as and when required, generally in the form of preformed mixtures. For institutional application, soft water is generally used.

The nonionic surfactant combination according to the invention in conjunction with the detergent ingredients mentioned above is particularly suitable for washing heavily soiled working apparel and is distinguished by high washing power with respect to stains containing mineral oil.

EXAMPLES

Example 1

The linear $C_{12-14}$, alcohol alkoxylates (components a and b) used to produce the surfactant combination had the following C chain distribution: $C_{10}$ 0.5% by weight, $C_{12}$ 72.5% by weight, $C_{14}$ 26.0% by weight, $C_{16}$ 1.0% by weight. The concentrate had the following composition:

(a) 30% by weight $C_{12-14}$ alcohol+3 EO (nre)
(b) 30% by weight $C_{12-14}$ alcohol+5 EO+4 PO (nre)
(c) 30% by weight $C_{13}$ oxoalcohol+3 EO
(d) 10% by weight water.

The clear concentrate was exposed to a temperature varying from −10° C. to +40° C. in a 12-hour cycle over a period of 5 months in a conditioned atmosphere and showed no signs of separation. Slight clouding which began at −5° C. disappeared again at 0° C., Another sample stored for several months at −5° C. showed identical behavior.

Viscosity measurements carried out with a Carrimed rotational rheometer produced the following results:

| °C. | mPa · s |
|---|---|
| 0 | 252 |
| 5 | 162 |
| 10 | 115 |
| 15 | 84 |
| 20 | 62 |

The viscosity was independent of the shear rate (no thixotropy) over the measuring range (5 $s^{-1}$ to 100 $s^{-1}$).

The washing tests were carried out as follows: "Frista" automatic washing machine, capacity 7.5 kg, quantity used 5 kg normally soiled textiles (ballast washing) plus artificially soiled test swatches Water hardness 0° Gh.

Ratio of washing to wash liquor 1:7.5

1st Wash cycle 15 mins. at 80° C. with 75 ml surfactant combination and 175 g washing powder 2nd Wash cycle 15 mins. at 70° C. with 175 g washing powder.

After the first wash cycle, the wash liquor was drained off and the washing was rinsed once with water at 70° C. After the 2nd wash cycle, the washing was rinsed 5 times.

The washing powder added had the following composition (in % by weight):

| | |
|---|---|
| $C_{9-13}$ alkyl benzene sulfonate | 1.6 |
| $C_{12-16}$ fatty alcohol + 7 EO | 3.0 |
| $Na_5P_3O_{10}$ | 20.0 |
| Soda | 25.0 |
| Sodium metasilicate | 45.0 |
| Cellulose ether | 1.5 |

-continued

| | |
|---|---|
| Hydroxyethane diphosphonate | 0.4 |
| Optical brightener | 0.1 |
| Water | Balance |

The following artificially soiled test swatches were tested:

I) carbon black, vegetable fat and mineral oil on crease-resistant cotton

II) carbon black, vegetable fat and mineral oil on a blend of polyester and crease-resistant cotton III) carbon black and mineral oil on crease-resistant cotton IV) dust and sebum on cotton.

Two liquid concentrates A and B, which are commercially available solvent (alcohol, glycols)-containing products for the same field of application, were used for comparison. They are both among the leading products in the field in question. The results are set out in the following Table. The figures represent photometrically determined remission values.

| | Remission (in %) | | |
|---|---|---|---|
| Soil | Example 1 | A | B |
| I | 54.3 | 52.7 | 53.6 |
| II | 45.7 | 44.5 | 45.2 |
| III | 69.6 | 69.0 | 69.5 |
| IV | 65.9 | 64.5 | 64.5 |

Washing tests with a phosphate-free zeolite-containing detergent produced comparable results.

Example 2

A surfactant combination had the following composition (in % by weight):

| | |
|---|---|
| $C_{12-14}$ alcohol + 3 EO (nre) | 40 |
| $C_{12-14}$ alcohol + 5 EO + 4 PO (nre) | 40 |
| $C_{13}$ oxoalcohol + 3 EO | 10 |
| Water | 10 |

The combination was stable at temperatures varying from −10° C. to +40° C. Clouding which began at 0° C. disappeared again at +3° C. The combination had the following viscosities at the temperatures shown irrespective of the shear rate:

| °C. | mPa · s |
|---|---|
| 5 | 170 |
| 10 | 116 |
| 15 | 87 |
| 20 | 63 |

It was equivalent and, in individual cases (samples I and II), superior in its washing performance to the combination of Example 1.

Example 3

A surfactant combination had the following composition (in % by weight):

| | | |
|---|---|---|
| $C_{12-14}$ alcohol + 3 EO (nre) | | 25 |
| $C_{12-14}$ alcohol + 5 EO + 2.5 PO | (narrow-range homolog distribution for EO and PO) | 20 |
| $C_{13}$ oxoalcohol + 8 EO | | 25 |
| $C_{13}$ oxoalcohol + 3 EO | | 10 |
| Water | | 10 |

The combination was stable at temperatures varying from −10° C. to +40° C., i.e. a clear homogeneous liquid with no tendency to separate was present, even after repeated changes in temperature. The combination had the following viscosities at the temperatures shown irrespective of the shear rate:

| °C. | mpa · s |
|---|---|
| 0 | 329 |
| 5 | 222 |
| 10 | 156 |
| 15 | 113 |
| 20 | 85 |

It was equivalent in its washing performance to the combination of Example 1.

What is claimed is:

1. A liquid nonionic surfactant combination having improved low temperature stability which consists essentially of:

(a) from about 20% to about 50% by weight of an alcohol ethoxylate derived from primary linear $C_{12-15}$ alcohols having an average degree of ethoxylation equal to from about 2 to 7;

(b) from about 20% to about 50% by weight of an alcohol alkoxylate derived from primary saturated alcohols containing 12 to 15 carbon atoms in which the alcohol radical can be linear, methyl-branched in the 2-position, or a mixture of said linear and said methyl-branched radicals, having an average degree of ethoxylation equal to from about 3 to about 7 and an average degree of propoxylation equal to from about 2 to about 8; and (c) from about 5% to about 50% by weight of an alcohol ethoxylate derived from oxoalcohol mixtures of primary, linear, and 2-methyl-branched $C_{12-15}$ alcohols having an average degree of ethoxylation equal to from about 2 to about 8 the balance comprising not more than 20% by weight water.

2. The composition of claim 1 wherein said component (a) is derived from primary linear $C_{12-14}$ alcohols having an average degree of ethoxylation equal to from about 2 to about 5.

3. The composition of claim 1 wherein the amount of component (a) is from about 20% to about 45% by weight.

4. The composition of claim 3 wherein the amount of component (a) is from about 25% to about 40% by weight.

5. The composition of claim 1 wherein said component (b) is derived from primary linear $C_{12-14}$ alcohols of the formula $$R-(EO)_x-(PO)_y-OH$$

wherein R is a linear $C_{12-14}$ alcohol radical, EO is an ethylene oxide group, PO is a propylene oxide group, x is a number from about 3 to about 7 and y is a number from about 2 to about 8.

6. The composition of claim 5 wherein x is a number from about 4 to about 6 and y is a number from about 2 to about 5.

7. The composition of claim 11 wherein the amount of component (b) is from about 20% to about 45% by weight.

8. The composition of claim 7 wherein the amount of component (b) is from about 25% to about 40% by weight.

9. The composition of claim 1 wherein said component (c) is derived from a mixture of primary linear and 2-methyl branched $C_{13-14}$ alcohols having an average degree of ethoxylation equal to from about 2.5 to about 4.

10. The composition of claim 1 wherein the amount of component (c) is from about 10% to about 45% by weight.

11. The composition of claim 1 further comprising up to about 20% by weight of water.

12. The composition of claim 11 wherein the amount of water is from about 5% to about 15% by weight.

13. A process for cleaning a soiled fabric selected from the group consisting of cotton, and a blend of polyester and crease-resistant cotton which comprises contacting said fabric with a composition of claim 1 in an aqueous washing liquor.

14. The composition of claim 6 wherein y is a number of from about 2 to about 3.

15. The composition of claim 1 wherein in component (c) the degree of ethoxylation, is from about 2 to about 5.

16. The composition of claim 25 wherein said degree of ethoxylation is from about 2.5 to about 4.

17. The composition of claim 1 wherein the amount of component (c) is from about 15 to about 40% by weight.

18. The composition of claim 1 wherein the amount of component (a) is from about 20% to about 45% by weight, and component (a) is derived from primary linear $C_{12-14}$ alcohols having an average degree of ethoxylation equal to from about 2 to about 5; the amount of component (b) is from about 20% to about 45% by weight; and the amount of component (c) is from about 10% to about 45% by weight, and component (c) is derived from a mixture of primary linear and 2-methyl branched $C_{12-14}$ alcohols having an average degree ethoxylation equal to from about 2 to about 5.

19. The composition of claim 18 wherein component (b) is derived from primary linear $C_{12-14}$ alcohols of the formula $$R-(EO)_x-(PC)_y-OH$$

wherein R is a linear $C_{12-14}$ alcohol radical, EO is an ethylene oxide group, PO is a propylene oxide group, x is a number from about 3 to about 7 and y is a number from about 2 to about 8.

20. The composition of claim 19 wherein the amount of component (a) is from about 25% to about 40% by weight; the amount of component (b) is from about 25% to about 40% by weight; and the amount of component (c) is from about 15 to about 40% by weight.

* * * * *

UNITED STATES PATENT AND TRADEMARK OFFICE

CERTIFICATE OF CORRECTION

PATENT NO. : 5,364,552

DATED : Nov. 15, 1994

INVENTOR(S) : Merz et. al.

It is certified that error appears in the above-indentified patent and that said Letters Patent is hereby corrected as shown below:

In claim 7, column 7, line 4, "claim 11", should read:
-- claim 1 --.

In claim 16, column 8, line 1, "claim 25", should read:
-- claim 15 --.

On title page, [54] title, third line of title should read:
-- LOW-TEMPERATURE STABILITY --.

Signed and Sealed this

Twentieth Day of June, 1995

*Attest:*

Bruce Lehman

BRUCE LEHMAN

*Attesting Officer*

*Commissioner of Patents and Trademarks*